US005434657A

United States Patent [19]

Berkes et al.

[11] Patent Number: 5,434,657

[45] Date of Patent: Jul. 18, 1995

[54] BRUSH FOR APPLYING RELEASE AGENT TO INTERMEDIATE TRANSFER MEMBER

[75] Inventors: John S. Berkes, Webster; John S. Chambers, Rochester, both of N.Y.

[73] Assignee: Xerox Corporation, Stamford, Conn.

[21] Appl. No.: 267,738

[22] Filed: Jun. 29, 1994

[51] Int. Cl.[6] ..... G03G 15/14

[52] U.S. Cl. ..... 355/273; 355/271

[58] Field of Search ..... 355/271-273, 355/275, 281; 118/DIG. 1

[56] References Cited

U.S. PATENT DOCUMENTS

| | | | |
|---|---|---|---|
| 3,664,300 | 5/1972 | Joseph | 118/637 |
| 3,957,367 | 5/1976 | Goel | 355/271 X |
| 4,796,048 | 1/1989 | Bean | 355/277 |
| 5,065,183 | 11/1991 | Morofuji et al. | 355/272 X |
| 5,119,140 | 6/1992 | Berkes et al. | 355/297 |
| 5,175,591 | 12/1992 | Dunn et al. | 355/273 |

*Primary Examiner*—William J. Royer
*Attorney, Agent, or Firm*—Oliff & Berridge

[57] ABSTRACT

A method and apparatus for maintaining high surface gloss and toner particle release properties of an intermediate transfer member for an electrostatographic printing machine. The apparatus includes a buffing brush in which the fibers of the brush act to smooth out the intermediate transfer member surface to maintain high gloss. The fibers may also themselves be capable of breaking down to apply a thin film coating of release agents, or alternatively, the buffing brush may include liquid or solid release agents that are applied as a thin film coating by the buffing brush.

32 Claims, 3 Drawing Sheets

BRUSH FOR APPLYING RELEASE AGENT TO INTERMEDIATE TRANSFER MEMBER

FIELD OF THE INVENTION

This invention relates to an apparatus and method for buffing an intermediate toner transfer member to maintain the member's surface gloss while at the same time applying a release agent to the member to aid in achieving about 100% toner transfer from the member.

BACKGROUND

In a typical electrostatographic printing machine (such as a photocopier, laser printer, facsimile machine or the like), an imaging member is employed that is exposed to an image to be printed. Exposure of the imaging member to the image to be printed records an electrostatic latent image on the imaging member corresponding to the informational areas contained within the image to be printed. Generally, the electrostatic latent image is developed by bringing a toner or developer mixture into contact therewith.

The developed toner image recorded on the imaging member may be transferred to an image receiving substrate such as paper via an intermediate transfer member. The toner image particles may be transferred by heat and/or pressure to an intermediate transfer member, or more commonly, the toner image particles may be electrostatically transferred to the intermediate transfer member by means of an electrical potential between the imaging member and the intermediate transfer member. After the toner image has been transferred to the intermediate transfer member, it is then transferred to the image receiving substrate, such as by contacting the substrate with the image on the intermediate transfer member under heat and/or pressure.

Intermediate transfer members enable high throughput at modest process speeds. In four-color systems, the intermediate transfer member also improves registration of the final color toner image. In such systems, the four component colors of cyan, yellow, magenta, and black are synchronously developed onto one or more imaging members and transferred in registration onto an intermediate member at a transfer station.

In electrostatic printing machines in which the toner image is transferred by heat and pressure from the intermediate transfer member to the image receiving substrate such as paper, it is important that the transfer of the toner particles to the image receiving substrate be as complete as possible. Less than complete transfer to the image receiving substrate results in image degradation and low resolution. Near complete transfer is particularly important when the imaging process involves generating full color images since undesirable color deterioration in the final colors can occur when the primary color images are not efficiently transferred from the intermediate transfer member.

Thus, it is important that the intermediate transfer member surface have excellent release characteristics with respect to the toner. Conventional materials known in the art for use as intermediate transfer members possess the strength and electrical conductivity necessary for use in such intermediate transfer members, but can suffer from poor release characteristics, especially with respect to higher gloss image receiving substrates.

It is also important for the production of high resolution images that the gloss of the image produced match the gloss of image receiving substrate such as paper. Paper comes in a broad range of glosses, from low to very high gloss, and it is difficult to maintain the gloss match of an image over the range of paper glosses.

U.S. Pat. No. 3,664,300 (Joseph) discloses an apparatus for treating the surface of an imaging member with a solid hydrophobic metal salt of a fatty acid by fibrous treating means. The treating means is preferable a woven or non-woven web of materials including furs, natural fibers such as cotton, wool and hair, and synthetic fibers such as nylon and cellulose derivatives.

U.S. Pat. No. 4,796,048 (Bean) discloses an apparatus which transfers a plurality of liquid images from a photoconductive member to a copy sheet utilizing an intermediate transfer belt. The intermediate transfer belt can optionally be cleaned with a brush having flexible bristles following transfer of the image to the image receiving substrate. No materials for forming the flexible bristles are disclosed.

U.S. Pat. No. 5,119,140 (Berkes et al.) discloses a single layer intermediate transfer belt preferably fabricated from clear, carbon loaded or pigmented Tedlar® (a polyvinylfluoride available from E. I. du Pont de Nemours & Co.). Following transfer of the image to a plain paper substrate, the intermediate transfer belt is cleaned by a "conventional magnetic brush roll structure".

U.S. Pat. No. 5,175,591 (Dunn et al.) discloses a cleaning brush for a photoreceptor surface comprising bristles capable of abrading the photoreceptor surface. The abrasions aid in the removal of toner particles adhering to the photoreceptor surface following transfer of the image to a substrate via an intermediate transfer device. Dunn et al. does not disclose the use of a cleaning brush for an intermediate transfer member. The bristles of the brush must be of sufficient hardness to scratch the photoreceptor surface. The bristles are preferably polypropylene. Further, Dunn et al. discloses that fibers of polytetrafluoroethylene are too soft and unsatisfactory in that they undesirably deposit polytetrafluoroethylene on the photoreceptor surface.

The need remains for a method of maintaining an intermediate transfer member's release properties throughout its useful life while also improving the matching of image gloss to substrate gloss.

SUMMARY OF THE INVENTION

It has surprisingly been discovered that high resolution images can be achieved with excellent gloss match of the image and the image receiving substrate if an intermediate transfer member surface has high gloss and excellent release properties.

It is an object of this invention to create a method for maintaining the release properties of an intermediate transfer member by continuous application of a release agent to the transfer member's surface, while simultaneously maintaining the transfer member's surface gloss.

It is another object of this invention to create an apparatus which will simultaneously apply a release agent to the surface of an intermediate transfer member and maintain the surface gloss of the transfer member.

These and other objects are achieved by utilizing a buffing brush that contacts the intermediate transfer member as such member moves along its path. The brush fibers can be made of a material that is capable of both buffing the transfer member's surface and slowly breaking down to apply a thin film that acts as a release agent. Alternatively, the brush fibers can be composed of any suitable fibers capable of buffing the surface of an intermediate transfer member and the brush filled with liquid or solid release agents that are applied as a thin film by the brush. Furthermore, the brush can be used to buff the transfer member surface with the release agent material applied at a separate treating station.

DETAILED DESCRIPTION OF PREFERRED EMBODIMENTS

Figure 1:
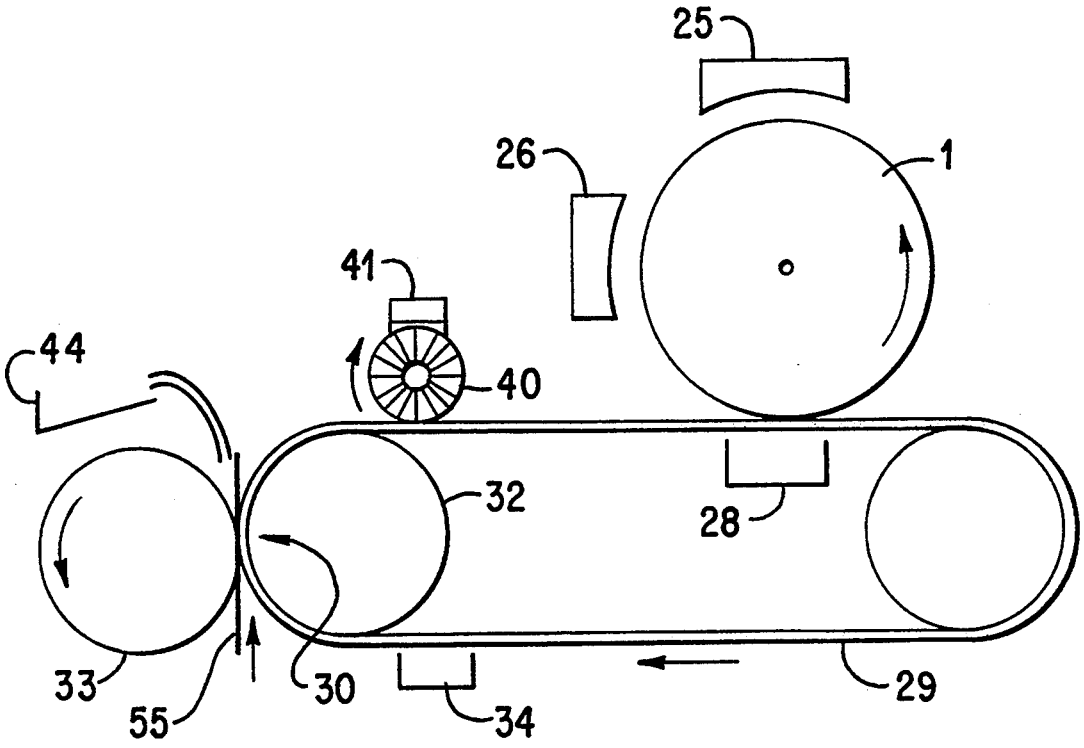
FIG. 1 is a schematic view of an image development system containing an intermediate transfer member and buffing brush.

FIG. 1 illustrates an example of an electrostatographic printing machine. The imaging member 1 is exemplified by a photoreceptor drum. However, other appropriate imaging members may include electrostatographic imaging receptors such as ionographic belts and drums, electrophotographic belts, etc.

In the imaging system of FIG. 1, each image being transferred is formed on the imaging drum by image forming station 25. Each of these images is then developed at developing station 26 and transferred to an intermediate transfer member 29. The image can be either a single image or a multi-image. In a multi-image system, each of the images may be formed and developed sequentially on the photoreceptor drum 1 and then transferred to the intermediate transfer member 29, or, in an alternative method, each image may be formed on the photoreceptor drum 1, developed, and transferred in registration to the intermediate transfer member 29.

In a preferred embodiment of the invention, the multi-image system is a color copying system. In this color copying system, each color of an image being copied is formed on the photoreceptor drum. Cyan, yellow, magenta and black are the four toner colors commonly used in such color copying systems. Each of these color images is then developed and transferred to the intermediate transfer member 29. As above, each of the colored images may be formed and developed sequentially on the drum 1 and then transferred to the intermediate transfer member 29, or, in the alternative method, each color of an image may be formed on the photoreceptor drum 1, developed, and transferred to the intermediate transfer member 29. Furthermore, each color image may be exposed and developed at each of four separate imaging and developing machines, as disclosed in Berkes, et al., U.S. Pat. No. 5,119,140, herein incorporated by reference in its entirety.

In the above described printing processes, the images are preferably developed using a liquid developer, although conventional dry toner may also be used. Liquid developers comprise toner particles disposed within a liquid carrier. The toner particles generally comprise a suitable resin binder such as polyethylene methacrylic acid or styrenebutadiene and a suitable colorant in the form of a dye or pigment. The liquid carrier conventionally comprises a solvent such as Isopar® (branched aliphatic hydrocarbons available from Exxon Chemical Corporation) or Norpar® (high purity normal paraffinic liquids available from Exxon Chemical Corporation). The liquid developer and toner particles can also include known adjuvants such as charge directors, surfactants for improved solubility and plasticizers.

After latent image forming station 25 has formed the latent image on the photoreceptor drum 1 and the latent image has been developed at developing station 26, the developed toner image is transferred to the intermediate transfer member 29. Transfer is effected with transfer mechanism 28. If toner transfer is to be by an electrostatic method, transfer mechanism 28 can comprise any suitable charging mechanism well known in the art such as a biased transfer roller or a corona disk charge device. If toner transfer is to be by heat and/or pressure, transfer mechanism 28 comprises a roller which may be heated.

The intermediate transfer member 29 is shown in FIG. 1 as a belt. However, other well known forms for the intermediate transfer member are equally suitable, including intermediate transfer members in the form of a sheet or a roller.

Figure 3:
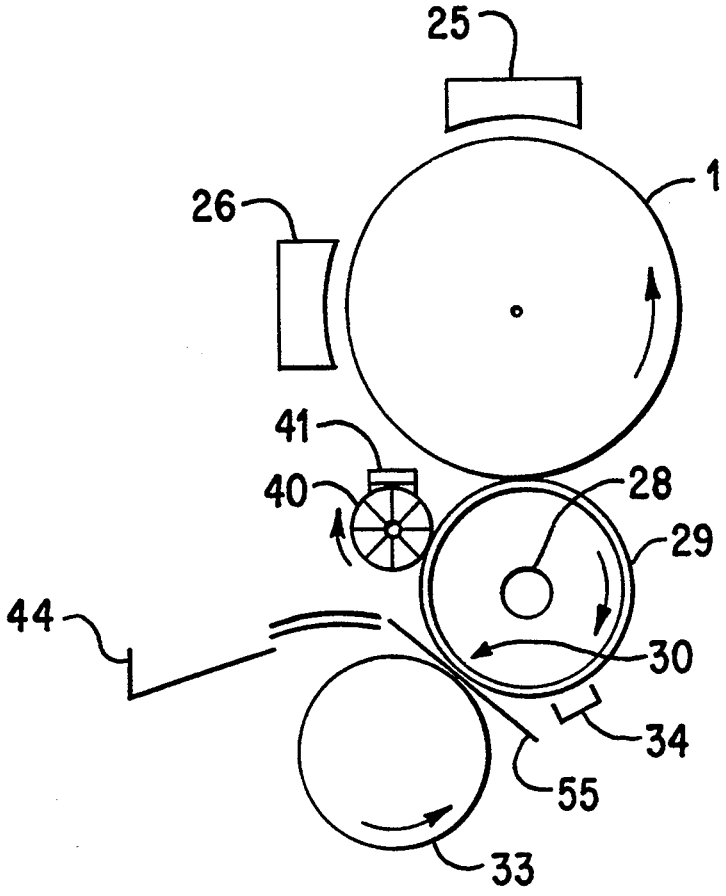
FIG. 3 is a schematic view of an image development system utilizing a roller as an intermediate transfer member.

In FIG. 3, intermediate transfer member 29 is shown as a roller. The reference numerals in FIG. 1 correspond to the reference numerals in FIG. 3. The intermediate transfer member 29 needs to be comprised of a material that has good dimensional stability, is resistant to attack by materials of the toner or developer, is conformable to an image receiving substrate and is preferably electrically semiconductive. Preferably, the intermediate transfer member is comprised of a fluorocarbon elastomer. Fluorocarbon elastomers are commercially available, for example under the trade names Viton® or Fluorel®, both available from E. I. du Pont de Nemours & Co. The intermediate transfer member 29 may comprise the fluorocarbon elastomer as a single layer, or the fluorocarbon elastomer may be coated upon a thermally conductive and electrically semiconductive substrate. Under some conditions, electrically conductive substrates can be used. Examples of suitable substrate materials include but are not limited to polyimides, stainless steel and numerous metallic alloys.

After the toner latent image has been transferred from the imaging member 1 to the intermediate transfer member 29, the intermediate transfer member is contacted at point 30 under heat and pressure with an image receiving substrate 55, which is preferably paper. Roller 32 supplies the requisite heat and roller 33 supplies the requisite pressure. Alternatively, the intermediate transfer member and toner can be heated prior to contacting an image receiving substrate by heating member 34. Heating member 34 can be used alone or in conjunction with heat supplied by roller 32. The toner image on the intermediate transfer member 29 is then transferred and fixed, in image configuration, to the substrate 55. The substrate with the image thereon is then transported to output tray 44.

While the preferred intermediate transfer member fluorocarbon elastomers possess excellent strength and conformability for use as intermediate transfer members, such fluorocarbon elastomers do not allow for 100% toner particle transfer and do not maintain a high surface gloss necessary to match the surface gloss of an image to a broad range of image receiving substrates. Both of these inadequacies result in low resolution images upon the image receiving substrate. By this invention, the inventors have discovered that by use of the present invention, the intermediate transfer member surface can be maintained at high gloss levels throughout the intermediate transfer member's useful life and the release properties of the intermediate transfer member surface with respect to the toner particles are excellent with at or very near 100% toner transfer.

Following transfer of the toner image from the intermediate transfer member to the image receiving substrate and prior to the intermediate transfer member 29 advancing to receive another toner image from the imaging member, intermediate transfer member 29 is treated by buffing brush 40.

Buffing brush 40 acts to buff (i.e. smooth out) the surface of the intermediate transfer member to a high gloss. In preferred embodiments, the brush can also act to apply a thin film coating of a release agent to the surface of the intermediate transfer member. Buffing brush 40 is preferably a rotary brush that operates at a speed of 100–10,000 rpm, preferably 100–3,000 rpm.

In one embodiment of the buffing brush 40, the brush fibers are comprised of materials that possess sufficient rigidity and toughness to adequately buff the surface of the intermediate transfer member. Preferably, the materials may be fluoropolymers, for example fluorocarbons, tetrafluoroethylene, polyvinyl fluoride, polyvinylidene fluoride and other fluorocarbon variants such as fluorocarbon-containing mixtures. Most preferably, the buffing brush fibers are comprised of polytetrafluoroethylene (PTFE), such as is commercially available under the trade name Teflon®. In this embodiment, the fibers serve a dual purpose in the buffing brush. First, the fibers have sufficient rigidity and toughness to smooth out ridges in the intermediate transfer member surface to produce and maintain a high surface gloss. Second, the fibers break down into minute fluoropolymer particles to fill valleys in the intermediate transfer member surface.

Further, microparticles of the fiber material can form a thin, continuous, low surface energy, poorly adhered ablative film coating upon the intermediate transfer member surface. The thickness of the film coating is preferably between about 100 and about 15,000 Angstroms, most preferably between about 1,000 and about 10,000 Angstroms. The fiber materials in this embodiment are comprised of materials that have release properties with respect to toner particles so that the thin film coating also acts as a release agent. Thus, by the use of such fibers in the buffing brush, both high gloss and excellent release of the intermediate transfer member surface can be achieved. The breakdown of the fibers into microparticles occurs at a very slow rate such that the buffing brush outlasts the useful life of the intermediate transfer member.

in a second embodiment of the buffing brush, the buffing brush fibers can be comprised of any fiber of sufficient rigidity and toughness to be able to smooth out the surface ridges of the material of the intermediate transfer member surface. Examples of fibers that are suitable include, but are not limited to, polyester fibers such as Mylar® (available from E. I. du Pont de Nemours & Co.), polyamide fibers such as nylon, or polyolefin fibers such as polyethylene and polypropylene.

Unlike the first embodiment described above, the fiber materials in this embodiment need not possess release properties with respect to toner particles. Thus, it is necessary to have a separate release agent material in association with the buffing brush. The release agent material can be in liquid or solid form and may be located on and/or between the buffing brush fibers. Suitable release agent materials include polyolefins (waxes and polymers), fluorinated polymers such as Teflon® (a polytetrafluoroethylene) or Fluoroglide®, silicone polymers and oligomers, and polymers with grafts of the above polymers, and mixtures thereof as disclosed in U.S. patent application Ser. No. 08/268,386, (JAO 29076), filed simultaneously herewith, and which is herein incorporated by reference in its entirety. Preferably, fluoropolymers are used as the release agent material. Additional supply of release agent can be located in a reservoir 41 associated with the buffing brush that applies more release agent materials to the brush as needed. The buffing brush thus acts to buff the surface of the intermediate transfer member with the fibers of the brush while simultaneously applying a thin film coating of a release agent material to the surface of the intermediate transfer member. As in the first embodiment, the thickness of the film coating is preferably between about 100 and about 15,000 Angstroms, most preferably between about 1,000 and about 10,000 Angstroms. The brush acts to apply the thin film at a relatively uniform thickness.

As an alternative to the second embodiment, the thin film coating of release agent material can be applied at a separate upstream or downstream station from the buffing brush. The separate station is preferably located upstream from the buffing brush so that the brush can act to level the thin film release agent coating. However, it is preferred that the buffing brush itself be used for application of the thin film coating of release agent material as well.

In an apparatus employing a buffing brush of the invention, it is preferable to include a conventional flexible bristle cleaning brush such as known in the art upstream from the buffing brush location on the intermediate transfer member. In the event that toner residue remains on the transfer member surface following transfer of the image to an image receiving substrate, a cleaning brush would clean the surface of such toner residue. If toner residue builds up on the buffing brush, the ability of the buffing brush to apply a thin film coating of release agent material may be interfered with.

Following buffing and application of the release agent, the intermediate transfer member advances and is ready to receive another toner image from imaging member 1 to begin the transfer process anew.

Figure 2:
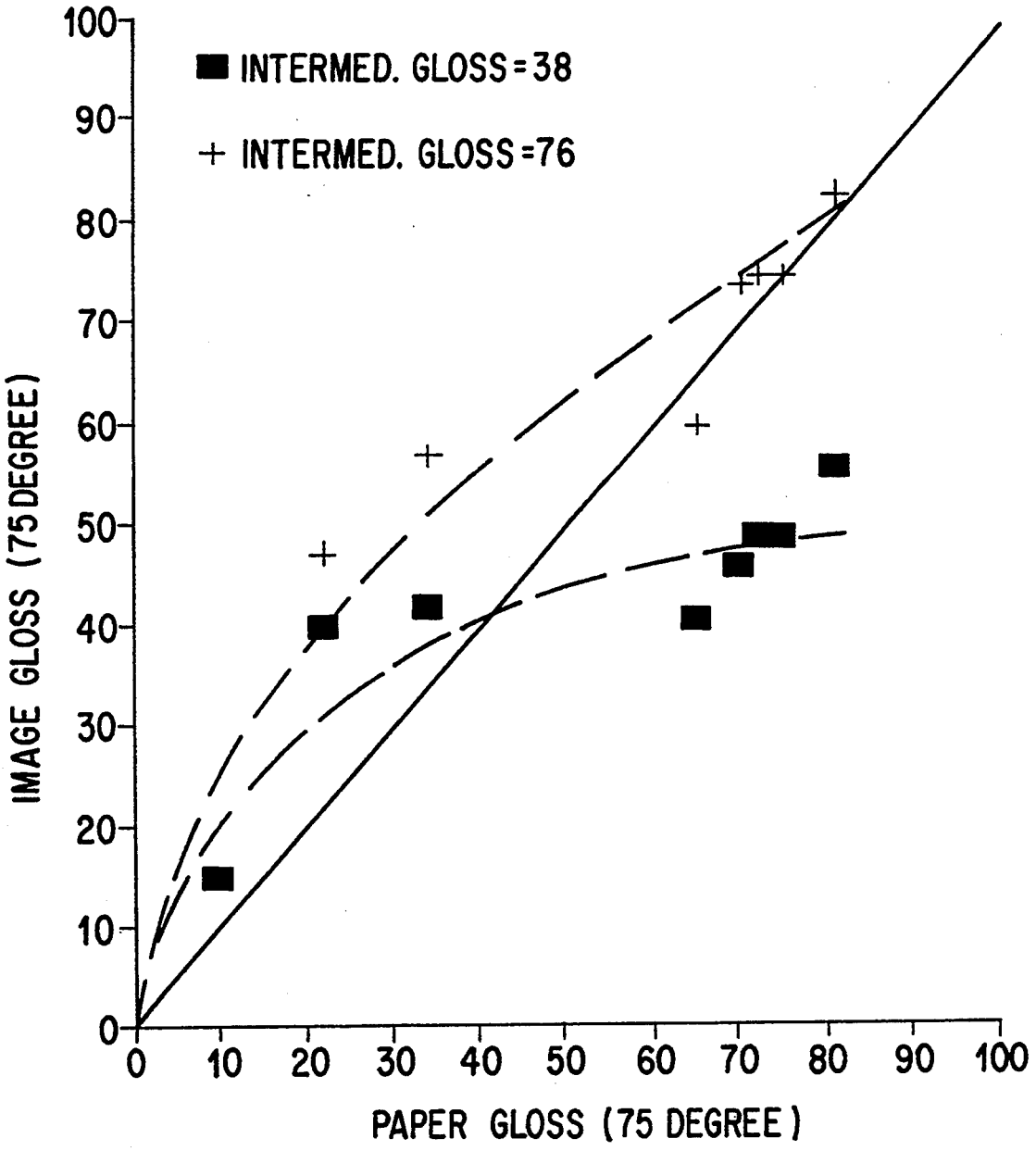
FIG. 2 is a comparison of image gloss with paper gloss following transfer of an image to the paper from an intermediate transfer member treated by the present invention.

FIG. 2 illustrates the ability of an intermediate transfer member treated by a buffing brush as described above to match the gloss of an image transferred to a range of glosses of an image receiving substrate. The intermediate transfer member utilized has a surface of a fluorocarbon elastomer sold commercially under the name Viton®. The surface has a thin film coat of fluoropolymer release agent applied by a buffing brush of the invention.

The toner utilized is also known, and comprises Nucrel® 599 (a polyethylene methacrylic acid available from E. I. du Pont de Nemours & Co.) in Isopar-L® (a branched aliphatic hydrocarbon solvent available from Exxon Chemical Corporation) with any suitable colorant well known in the art. The toner solids density is 0.2 $mg/cm^2$.

A variety of commercially available papers having varying glosses are used as the image receiving substrate. In order of low to high gloss as shown in FIG. 2, the papers are: Xerox ISLX 24#, Frostbrite Matte 70# (available from Consolidated Paper Co.), Productolith Dull 70# (available from Consolidated Paper Co.), Simpson Coated 1 Side 70#, Productolith Gloss 70# (available from Consolidated Paper Co.), Centura Gloss 70# (available from Consolidated Paper Co.), Lustrogloss 70# (available from S. D. Warren Co.) and Kromekote 100# (available from Champion Paper Co.). All of these papers with the exception of Xerox ISLX 24# are coated with formulations proprietary to each manufacturer. The papers have gloss levels ranging from about 10 Gardner Gloss Units for Xerox ISLX 24# to about 80 Gardner Gloss Units for Centura Gloss 70#, Lustrogloss 70# and Kromekote 100#.

The toner is transferred from the intermediate to the paper under a nip pressure of 220 psi and at a temperature of 100° C.

In FIG. 2, perfect image to paper gloss matching is indicated by the 45° line. As the Figure illustrates, the buffed and treated surface of the intermediate transfer member allows for excellent image-to-substrate gloss matching. This is indicated by the higher curve in the Figure representing an intermediate transfer member in which high surface gloss is maintained with the buffing brush of the invention. The excellent matching is a result of the high surface gloss of the transfer member surface as well as the surface's excellent release properties. The lower curve in the Figure represents a lower gloss untreated intermediate transfer member. As can be seen, the untreated intermediate transfer member surface suffers from poor image-to-substrate gloss matching, particularly with respect to high gloss image receiving substrates. Thus, an intermediate transfer member surface treated in accord with the present invention yields high resolution images over a broad range of image receiving substrate glosses throughout the entire useful life of the intermediate transfer member.

While this invention has been described in conjunction with specific embodiments thereof, it is evident that many alternatives, modifications, and variations will be apparent to those skilled in the art. Accordingly, it is intended to embrace all such alternatives, modifications and variations as fall within the spirit and scope of the appended claims.

What is claimed is:

1. A method for maintaining release properties and surface gloss of an intermediate transfer member in an electrostatographic printing machine, comprising applying a thin film coating of a release agent to a surface of said intermediate transfer member in said machine and buffing said surface of said intermediate transfer member.

2. A method according to claim 1, wherein said buffing of said surface of said intermediate transfer member is with a buffing brush.

3. A method according to claim 2, wherein one or more release agents are applied on the brush or immediately upstream or downstream from said buffing brush.

4. A method according to claim 2, wherein said coating of release agent is applied from said buffing brush simultaneously with said buffing.

5. A method according to claim 4, wherein said buffing brush comprises fibers that smooth the surface of said intermediate transfer member and break down during said buffing to apply a thin continuous coating of a fiber material to said intermediate transfer member surface, said fiber material thin continuous coating acting as said release agent.

6. A method according to claim 5, wherein said fibers comprise fluoropolymer fibers.

7. A method according to claim 6, wherein said fluoropolymer fibers comprise fluorocarbon fibers.

8. A method according to claim 7, wherein said fluorocarbon fibers comprise polytetrafluoroethylene.

9. A method according to claim 4, wherein said buffing brush comprises fibers capable of buffing said intermediate transfer member, said buffing brush further containing one or more release agents.

10. A method according to claim 9, wherein said release agents are liquid or solid.

11. A method according to claim 9, wherein said release agents comprise fluoropolymers, polyolefins, silicone polymers or mixtures thereof.

12. An apparatus for transferring a toner image from an imaging member to an image receiving substrate, said apparatus comprising an intermediate transfer member and a buffing brush that contacts the surface of said intermediate transfer member at a location downstream of a station for transfer of said toner image to said image receiving substrate, and means to apply to a surface of said intermediate transfer member a thin continuous coating of a release agent.

13. An apparatus according to claim 12, wherein said intermediate transfer member is in the form of a belt or roller.

14. An apparatus according to claim 12, wherein said buffing brush comprises fibers that smooth the surface of said intermediate transfer member and break down during said buffing to apply a thin continuous coating of a fiber material to said intermediate transfer member surface, said fiber material thin continuous coating acting as said release agent.

15. An apparatus according to claim 14, wherein said fibers comprise fluoropolymer fibers.

16. An apparatus according to claim 15, wherein said fluoropolymer fibers comprise fluorocarbon fibers.

17. An apparatus according to claim 16, wherein said fluorocarbon fibers comprise polytetrafluoroethylene.

18. An apparatus according to claim 12, wherein said buffing brush comprises fibers capable of buffing said intermediate transfer member, said buffing brush further containing release agents.

19. An apparatus according to claim 18, wherein said release agents are liquid or solid.

20. An apparatus according to claim 18, wherein said release agents are fluoropolymers, polyolefins, silicone polymers or mixtures thereof.

21. An apparatus according to claim 12, said buffing brush containing release agents supplied to said buffing brush by a release agent applicator.

22. An apparatus according to claim 12, further comprising immediately upstream or downstream from said buffing brush a member containing one or more release agents, said member applying said release agent to said intermediate transfer member surface as a thin continuous coating.

23. An apparatus for maintaining the release properties and surface gloss of an intermediate transfer member in an electrostatographic printing machine comprising a buffing brush and one or more release agent materials in association with said buffing brush.

24. An apparatus according to claim 23, wherein said buffing brush comprises fibers comprising said one or more release agent materials.

25. An apparatus according to claim 24, wherein said fibers comprise fluoropolymer fibers.

26. An apparatus according to claim 24, wherein said fluorocarbon fibers comprise polytetrafluoroethylene.

27. An apparatus according to claim 23, wherein said fluoropolymer fibers comprise fluorocarbon fibers.

28. An apparatus according to claim 23, wherein said buffing brush comprises fibers capable of buffing said intermediate transfer member, said buffing brush further containing one or more release agents.

29. An apparatus according to claim 28, wherein said release agents are on said fibers, between said fibers, or both on and between said fibers.

30. An apparatus according to claim 28, wherein said release agents are liquid or solid.

31. An apparatus according to claim 28, wherein said release agents comprise fluoropolymers, polyolefins, silicone polymers or mixtures thereof.

32. An apparatus for transferring a toner image from an imaging member to an image receiving substrate, said apparatus comprising transfer means for transferring a toner image to a substrate, means for buffing the surface of said transfer means and means for applying a thin continuous coating of a release agent material to said surface.

* * * * *